United States Patent [19]

Coloka

[11] Patent Number: 4,651,539

[45] Date of Patent: Mar. 24, 1987

[54] HEAT PUMP

[75] Inventor: Mita Coloka, Fallbrook, Calif.

[73] Assignee: Bengt Gustaf Thoren, Harwood, Tex.

[21] Appl. No.: 832,824

[22] Filed: Feb. 24, 1986

[51] Int. Cl.[4] ..... F25B 39/02

[52] U.S. Cl. ..... 62/504; 62/525; 62/526; 62/527

[58] Field of Search ..... 62/524, 527, 504, 525, 62/526, 471, 235.1

[56] References Cited

U.S. PATENT DOCUMENTS

| | | | |
|---|---|---|---|
| 1,899,378 | 2/1933 | Zouck et al. | 62/471 X |
| 1,922,942 | 8/1933 | Gay | 62/471 X |
| 2,603,954 | 7/1952 | Davis | 62/471 |
| 2,707,868 | 5/1955 | Goodman | 62/525 X |
| 2,877,631 | 3/1959 | McLean, Jr. | 62/527 X |
| 2,990,700 | 7/1961 | Weibert, Jr. | 62/527 |
| 4,182,133 | 1/1980 | Haas et al. | 62/504 X |
| 4,365,487 | 12/1982 | Dobney | 62/526 X |

*Primary Examiner*—Lloyd L. King

[57] ABSTRACT

A heat pump with high coefficient of performance. The heat pump includes a compressor (6), a condenser (2), and an evaporator (5). The condenser (2) is connected to a water accumulator (3). A pump (15) circulates the water from the accumulator and through the condenser (2). The evaporator (5) is connected to a heat medium of a suitable kind with which heat exchange takes place. The evaporator includes a plurality of relatively short tubes (22) connected in parallel. Each tube at the lower end thereof includes separation means for oil, which is directed via a separate duct (26) to a separate oil inlet of the compressor (16). The tubes of the evaporator includes restrictions (**22*b***) spaced along the length of the tubes. The restrictions are accomplished by the tubes being compressed while rotated. The rotations are preferably in different directions in adjacent compressions. These compressions substitute the restriction means in a conventional heat pump, and consequently the restriction means may be said to be distributed over the evaporator.

8 Claims, 3 Drawing Figures

HEAT PUMP

FIELD OF THE INVENTION

The present invention relates to a heat pump of an improved structure having higher efficiency and coefficient of performance than hitherto used heat pumps.

TECHNICAL BACKGROUND

Previously known heat pumps of the type to which the invention relates comprise a condenser, restriction means, an evaporator and a compressor. A coolant, such as Freon®, is pumped in a cycle through these components and carries heat energy from the evaporator at a low temperature to the condenser at a higher temperature. The condenser is connected to a heat receiver, such as a warm water accumulator, and the evaporator is connected to a heat emitter, such as the ambient air, well-water, salt water, soil heating loops, solar panels, heating from stables, or waste heat.

SUMMARY OF THE INVENTION

In accordance with the invention it has been discovered that the coefficient of performance may be increased compared to conventional heat pumps. The invention relates to a heat pump of the type disclosed above, wherein the restriction means is distributed along the tubes of the evaporator. Thus, the tubes of the evaporator are provided with a plurality of restrictions spaced along the length thereof. Preferably, the restriction consists of compressions in the tubes at spaced locations on the tubes, the compressions being designed to effect a rotation of the coolant passing through the restrictions.

In accordance with the invention the heat pump comprises a condenser, reducing means, an evaporator comprising a plurality of tubes and a compressor, which are interconnected in a closed loop, through which a coolant is pumped by the compressor to carry heat energy from a low temperature in the evaporator to a higher temperature in the condenser, with the improvement that the reducing means is provided by a plurality of restrictions spaced along the tubes of the evaporator, which restrictions act as reducing means for the coolant and are spaced along the length of the tubes to form a reducing means distributed over the length of the evaporator, and the restrictions are such that they effect a rotation of the coolant passing through the restrictions.

According to the invention the tubes of the evaporator are provided with oil separation means at their lower ends, in which oil is separated from the coolant and fed in a separate duct to a separate oil inlet of the compressor. The condenser may be divided into two sections, the first section being an air-coolant heat exchanger and the other section being a water coolant heat exchanger. These two sections are connected in series, so that the compressor is connected directly to the air coolant heat exchanger. Alternatively, the evaporator may be connected directly to a solar panel.

BRIEF DESCRIPTION OF THE DRAWINGS

The invention will be described in greater detail below with reference to the accompanying drawings.

DETAILED DESCRIPTION OF PREFERRED EMBODIMENTS

Figure 1:
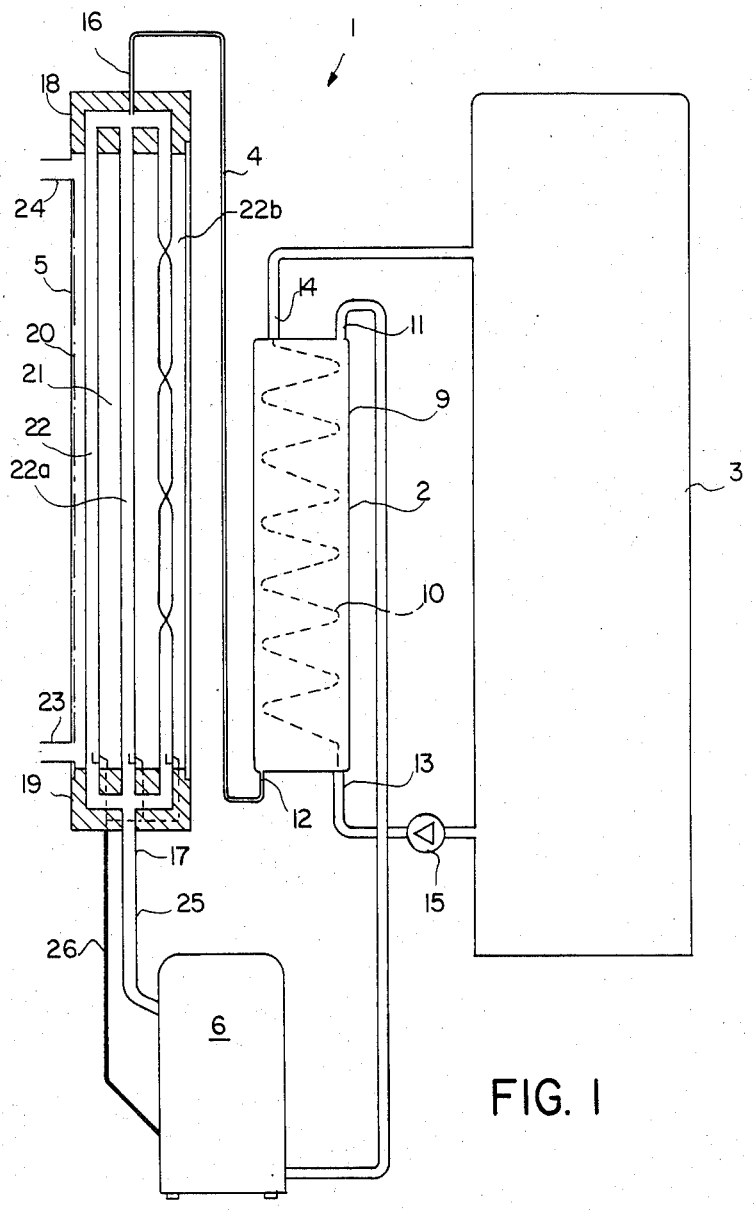
FIG. 1 is a schematic view partially in section of a heat pump in accordance with the invention.

In FIG. 1 the heat pump 1 in accordance with the invention is schematically shown. It comprises a condenser 2, a water accumulator 3, modified restriction means 4, an evaporator 5, and a compressor 6.

The condenser 2 consists of a closed cylinder 9 containing tubes 10 of copper or stainless steel arranged in a helical pattern, as indicated with broken lines in FIG. 1 Compressed gaseous coolant from the compressor at a temperature of e.g. +65° C. is supplied to an upper inlet 11 and liquid coolant is discharged from a lower outlet 12.

The cylinder 9 is also connected to the water accumulator 3 via an inlet tube 13 and an outlet tube 14. The water in the accumulator is circulated through the tube coil 10 and back to the accumulator by a circulation pump 15. Thus the water in the accumulator is heated.

The liquid coolant now condensed is directed from the outlet 12 in the cylinder 9 via a narrow tube 4 to the inlet 16 of the evaporator 5.

Normally the narrow tube is provided with a restriction means, a so called capillary tube or by a thermostatically controlled reducing valve, in which the pressure of the liquid coolant is decreased from the working pressure at the outlet side of the compressor to a low pressure. Thus, the temperature decreases accordingly. Normally the temperature is decreased to several degrees below 0° C., in a conventional heat pump down to about −45° C., so that heat energy may be absorbed in the evaporator.

In accordance with the present invention no separate restriction means is needed. Thus, the tube 4 may be a tube with an inner diameter of about 2 mm and of a length of about 1 m. Thus, the pressure is still relatively high at the inlet to the evaporator and also the temperature is relatively high, normally higher than about −8° C. This means that the evaporator according to the present invention is able to operate at lower temperatures, without running the risk of ice formation in the evaporator and still having a coefficient of performance of about 3. In conventional heat pumps, normally there are problems at temperatures below 0° C. with ice formation and a low coefficient of performance.

In accordance with previously known technique the evaporator 5 comprises long, often helically wound copper tubes, to give a great heat exchanging surface towards the heat carrier in the evaporator. According to the present invention the length is substantially reduced and in one exemplary embodiment eight copper tubes connected in parallel with a length of 800 mm (or 1000 mm) are used. This means that the evaporator 5 can be made very compact.

According to the invention the evaporator comprises an upper end piece 18 and a lower end piece 19 both circular in cross section. The end pieces 18, 19 are interconnected by a skirt 20 so that a cylindrical closed space 21 is formed. A number of copper tubes 22, e.g. eight, extend from end piece to end piece within the space 21 and are recessed in holes in the end pieces. These holes communicate with inlet 16 and outlet 17, respectively, so that the liquid coolant may be distributed and pass via inlet 16 to the different tubes 22 and to the outlet 17.

Each tube 22 is provided with flow obstructions 22*b*, which can be formed in different ways. The flow obstructions may be made by pinching or compressing and simultaneously rotating the tubes, as is shown schematically on one of the tubes in FIG. 1. The compressions and rotations may be at several sequentially and equally spaced locations on the tubes along their length. The distance between adjacent compressions is preferably 45 mm and a ½ inch diameter tube, but may be shorter e.g. 25 mm. The adjacent rotations may be directed in the same direction or in opposite directions. These flow obstructions serve to decrease the pressure and consequently the temperature of the coolant successively along the whole length of the tubes. Accordingly, the heat carrier outside the evaporator tubes is exposed to a decreasing temperature, while simultaneously giving off heat to the coolant and decreasing its own temperature. In this manner the temperature difference along the total length of the tubes will be substantially constant, which favours the heat transfer from the heat carrier to the coolant. The rotations serve to further improve said heat transfer. Thus, the rotations effect a rotation or whirl motion of the coolant passing the restrictions, thereby flinging out the relatively heavier liquid coolant against the inner walls of the tubes which improves the thermal contact therebetween, and forming a central channel, that permits the gaseous coolant to return more rapidly to the compressor. Hence the flow velocity of the coolant may be four times as high as in conventional heat pumps.

It is preferred that adjacent rotations are in opposite directions, but they may also be in the same direction. It is believed that the arrangement with opposite directions creates a more turbulent flow, which generally is more desirable in these applications.

The skirt 20 is provided with an inlet 23 and an outlet 24 for circulating the heat carrier with which the heat exchange will take place. Suitably, the inlet 23 is tangentially disposed to effect a whirl motion within the skirt 20. The heat carrier may be oil, water etc. depending on the application. If the heat in the air is to be used an external air-oil heat exchanger may be used, which via a pump circulates the oil in a cycle through the evaporator.

Finally the vaporized coolant is directed to the compressor 6 via a duct 25. Adequately the coolant is of a temperature of about +5° C. at the inlet to the compressor in order to avoid hammering. The compressor may be hermetically closed but other types of compressors may also be used.

Each tube 22 is provided with a collecting pocket at its lower end for collecting and separating oil. The oil is directed from the collecting pockets in a separate duct 26 to a second inlet to the compressor. In this way it is provided that the gaseous coolant entering the compressor 6 via duct 25 is to the greatest possible extent free from oil, which increases the effeciency of the whole system. That oil, which in spite of the separation thereof still is circulating through the system, is thereafter again partially separated in the collecting pockets.

The eight tubes 22 of the evaporator are appropriately spaced peripherally of the circular end pieces. However, there may also be a central tube 22*a* connected immediately under the central inlet 16. This central tube 22*a* is provided with a substantial restriction at the beginning of the tube, which restriction causes a great part of the coolant to be deflected to the eight outer tubes 22. However, oil particles that possibly may have been carried with the coolant have a higher density and will be separated from the coolant and pass down in the central tube 22*a*, having an additionally efficient collecting pocket for the oil. Alternatively, this central tube may be directly connected to the duct 26 in order to solely contain oil.

The evaporator is positioned vertically and above the compressor so that the duct 26 presents a natural slope to the compressor and that the oil because of gravity will run to the compressor.

The evaporator and the condenser arc manufactured and sized for a certain output in form of a package, e.g. for the output of 5 kW of output heat power. If 15 kW is desired, three such units are connected in parallel to the same compressor. This unit or package may then be optimized for best conditions and for best vaporization in the evaporator. An amazingly high coefficient of performance has been experienced with this unit. The whole heat pump may be contained in a box with the outer dimensions 400×450×1100 mm and weighs 78 kg.

The restrictions in the evaporator tubes may be said to perform the same function as the restriction means in a conventional heat pump. Thus, the function according to the invention may be described in that the restriction means is distributed over the evaporator, i.e. it is divided in a plurality of parts spaced from each other. It is assumed that the extremely efficient operation of the evaporator is effected by just this distributed restriction means. Most likely the coolant vaporized in an early stage by the evaporator may rapidly pass through the restrictions back to the compressor while the liquid coolant efficiently is prevented from reaching the compressor by the restrictions until it is vaporized. In this manner the vaporized coolant is rapidly carried off in order to permit a more efficient vaporization of the remaining liquid coolant. Also, the rotation of the restrictions in opposite directions has an influence on the function.

Finally the separation of oil before the compressor results in a more efficient heat transfer.

Figure 2:
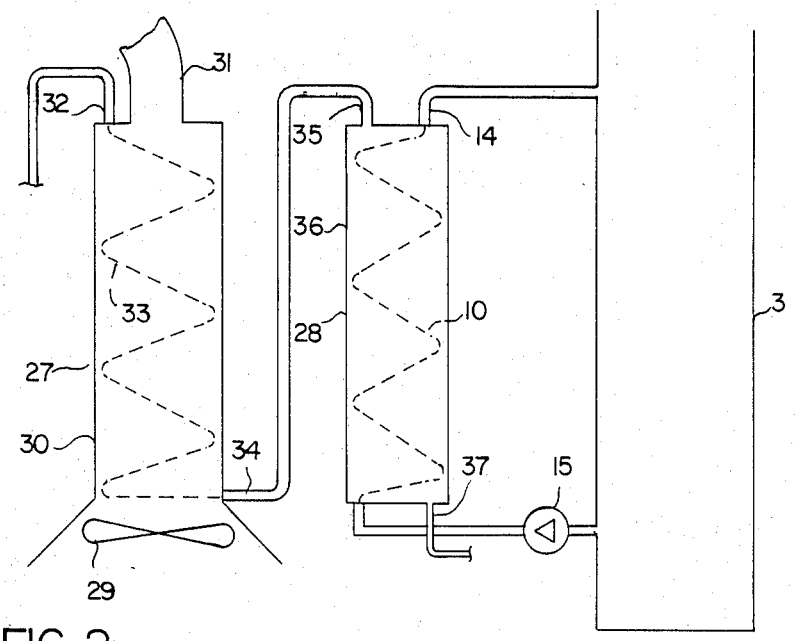
FIG. 2 is a schematic view of a variant of the condenser in the heat pump in accordance with the invention.

An alternative embodiment of the condenser is shown in detail in FIG. 2. The condenser is divided into two sections 27 and 28 connected in series. The first section 27 is an air/coolant heat exchanger. Air is pumped by a fan 29 through a cylinder 30 and is delivered to a warm air consumer via a tube 31. The warm coolant vapor is directed from the compressor to an inlet 32 and via a tube coil 33 within the cylinder 30 to an outlet 34. The air pumped through the cylinder is heated to a high temperature by the warm coolant vapor, which is partially condensed.

From the outlet 34 of the first section the coolant is directed to an inlet 35 to the other section 28 which is provided by a condenser of the same type as is shown in FIG. 1. Thus, this section consists of a cylinder 36 with a lower outlet 37 for the coolant. From the outlet 37 the coolant is directed further on to the evaporator. The water from the water accumulator 3 is circulated by the circulation pump 15 as in the embodiment according to FIG. 1, through tube coil 10 to an outlet 14 and back to the water accumulator 3. In this second section of the condenser the remaining cooling vapor is condensed, thereby heating the water.

Figure 3:
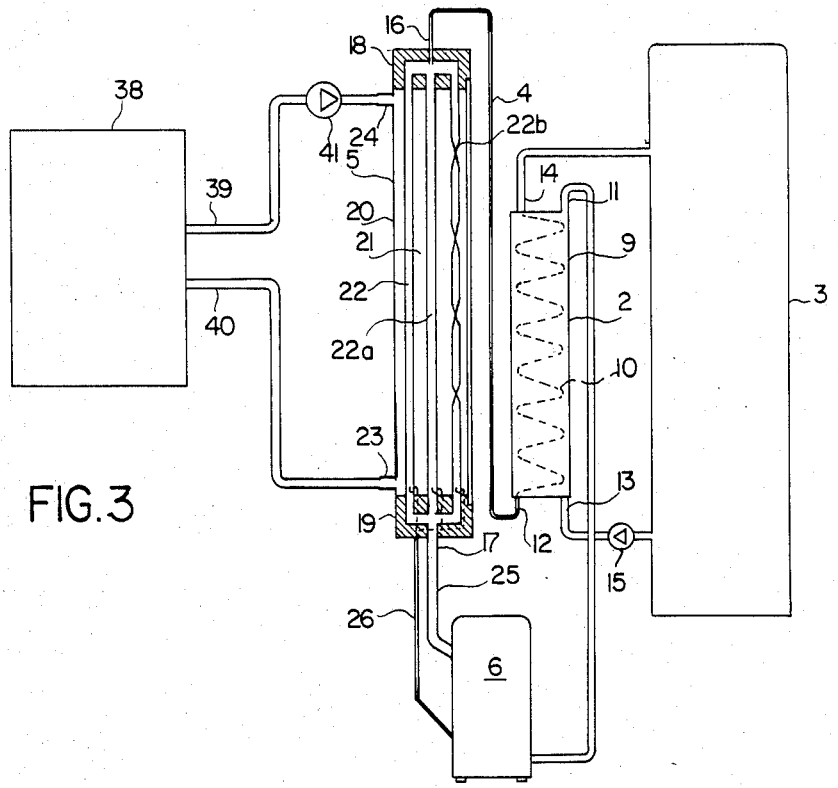
FIG. 3 is a schematic view of the heat pump according to the invention used together with a solar panel.

Finally, in FIG. 3 it is shown how a solar panel is connectable directly to the evaporator 5, the heat carrier in the solar panel 38 substituting the coolant within the cylinder 20. From the solar panel the heat carrier, e.g. oil, is directed via an outlet 39 to the inlet 24 of the evaporator 5 and back from the outlet 23 of the evaporator to the inlet 40 of the solar panel. A pump 41 provides an appropriate circulation.

The invention has been described above in exemplifying purposes and it will be appreciated by a person skilled in the art that the structure described may be modified in many ways within the scope of the invention. The intention is that modifications evident to a person skilled in the art is to be included within the scope of the invention and the invention is only limited by the claims below.

I claim:

1. In a heat pump comprising a condenser (2), a pressure reducing means, an evaporator (22) comprising a plurality of tubes and a compressor (6), which are interconnected in a closed loop, through which a coolant is pumped by the compressor to carry heat energy from a low temperature in the evaporator to a higher temperature in the condenser, the improvement which comprises the pressure reducing means being provided by a plurality of restrictions **(22*b*) spaced along the tubes (22)** of the evaporator, which restrictions act to reduce the pressure of the coolant and are spaced along the length of the tubes to form a pressure reducing means distributed over the length of the evaporator, and the restrictions being such that they effect rotation of the coolant passing through the restrictions.

2. A heat pump according to claim 1, wherein the adjacent restrictions **(22*b*)** effect a rotation of the coolant in different directions.

3. A heat pump according to claim 1, wherein the restrictions are provided by compressions of the tubes (22) at spaced locations of the tubes.

4. A heat pump according to claim 1, wherein the evaporator includes two circular end pieces (18, 19) interconnected by a skirt (20) defining a cylindrical space (21), in which said tubes (22) are disposed and in which a heat carrier at a low temperature is circulated.

5. A heat pump according to claim 4, wherein said tubes (22) are connected between the two end pieces within the skirt (20), and the end pieces include channels connecting an inlet (16) of the evaporator to one end of the tubes (22) and an outlet (17) from the evaporator to the other end of the tubes (22).

6. A heat pump according to claim 5, wherein said tubes (22) at the lower end thereof are provided with an oil separation means, in which oil is separated from the coolant and is directed in a separate duct (26) to a separate inlet to the compressor (6).

7. A heat pump according to claim 1, wherein the evaporator is connected directly to a solar panel.

8. A heat pump according to claim 1, wherein the tubes (22) of the evaporator are vertically disposed, and the coolant is supplied at the upper end of the tubes and is discharged at the lower ends of the tubes.

* * * * *